US008672181B2

(12) United States Patent
Schneider

(10) Patent No.: US 8,672,181 B2
(45) Date of Patent: Mar. 18, 2014

(54) DISPENSER FOR ADMINISTERING STRIP-SHAPED SUBSTANCES

(75) Inventor: Matthias Schneider, Heidesheim (DE)

(73) Assignee: SANNER GmbH, Bensheim (DE)

( * ) Notice: Subject to any disclaimer, the term of this patent is extended or adjusted under 35 U.S.C. 154(b) by 214 days.

(21) Appl. No.: 13/202,232

(22) PCT Filed: Mar. 23, 2010

(86) PCT No.: PCT/EP2010/001799

§ 371 (c)(1),
(2), (4) Date: Aug. 18, 2011

(87) PCT Pub. No.: WO2010/108649

PCT Pub. Date: Sep. 30, 2010

(65) Prior Publication Data

US 2011/0297695 A1 Dec. 8, 2011

(30) Foreign Application Priority Data

Mar. 24, 2009 (DE) ..... 10 2009 014 134

(51) Int. Cl.
*B65D 83/08* (2006.01)

(52) U.S. Cl.
USPC ..... 221/272; 221/269; 221/268; 221/259; 221/37

(58) Field of Classification Search
USPC ..... 221/37, 246, 249, 259, 268, 269, 272
See application file for complete search history.

(56) References Cited

U.S. PATENT DOCUMENTS

| | | | | |
|---|---|---|---|---|
| 3,276,622 | A * | 10/1966 | Krzyzanowski | 221/37 |
| 4,071,165 | A * | 1/1978 | Leopoldi | 221/259 |
| 4,739,902 | A * | 4/1988 | Joslyn et al. | 221/37 |
| 5,197,630 | A * | 3/1993 | Kirla | 221/37 |
| 7,287,666 | B2 * | 10/2007 | De Laforcade | 221/65 |
| 7,320,413 | B2 * | 1/2008 | Fusi | 221/255 |
| 7,661,555 | B1 * | 2/2010 | Evans et al. | 221/259 |

(Continued)

FOREIGN PATENT DOCUMENTS

| | | |
|---|---|---|
| DE | 20119188 U1 | 2/2002 |
| EP | 1 533 248 A1 | 5/2005 |

(Continued)

OTHER PUBLICATIONS

International Search Report issued for International Application No. PCT/EP2010/001799 mailed on Jun. 25, 2010.

*Primary Examiner* — Patrick Mackey
(74) *Attorney, Agent, or Firm* — Greer, Burns & Crain, Ltd.

(57) ABSTRACT

A dispenser for administering strip-shaped substances, includes a housing having a chamber to store a stack of the strip-shaped substances and forming a removal opening for the strip-shaped substances that can be opened and closed again with a lid, said lid being joined to the housing, and being joined to a transport bar that can be moved together with the lid in order to transport the strip-shaped substances. The objective of designing and refining a dispenser of the above-mentioned type in such a manner as to allow a contamination-free and reliable transport of one single strip-shaped substance from the inside of the housing merely by moving the lid is characterized in that the transport bar is elastically pre-tensioned and mounted in the housing in such a way that it is at a distance from the stack when the removal opening is closed.

20 Claims, 15 Drawing Sheets

(56) References Cited

U.S. PATENT DOCUMENTS

| | | | | |
|---|---|---|---|---|
| 7,819,283 | B2 * | 10/2010 | Chambers et al. | 221/272 |
| 7,946,450 | B2 * | 5/2011 | Gelardi et al. | 221/154 |
| 8,397,945 | B2 * | 3/2013 | Gelardi et al. | 221/45 |
| 2003/0106900 | A1 | 6/2003 | Storz | |
| 2005/0092763 | A1 | 5/2005 | Haggerty et al. | |
| 2005/0133524 | A1 | 6/2005 | De Laforcade | |
| 2005/0274733 | A1 | 12/2005 | Fusi | |
| 2009/0302048 | A1 | 12/2009 | Nobilet et al. | |

FOREIGN PATENT DOCUMENTS

| | | | |
|---|---|---|---|
| EP | 1 935 808 | A2 | 6/2008 |
| FR | 2 879 573 | A1 | 6/2006 |
| WO | WO 01/47786 | A1 | 7/2001 |
| WO | WO 2004/024593 | A1 | 3/2004 |
| WO | WO 2005/051822 | A1 | 6/2005 |

* cited by examiner

DISPENSER FOR ADMINISTERING STRIP-SHAPED SUBSTANCES

CROSS-REFERENCE TO RELATED APPLICATIONS

This application is a National Phase Application of PCT International Application No. PCT/EP2010/001799, International Filing Date Mar. 23, 2010, claiming priority of German Patent Application 10 2009 014 134.0, filed Mar. 24, 2009, which are all incorporated by reference herein.

FIELD OF THE INVENTION

The invention relates to a dispenser for administering strip-shaped substances, comprising a housing, said housing having a chamber to store a stack of the strip-shaped substances, said housing forming a removal opening for the strip-shaped substances that can be opened and closed again with a lid, said lid being joined to the housing, and said lid being joined to a transport bar that can be moved together with the lid in order to transport the strip-shaped substances.

BACKGROUND OF THE INVENTION

Such dispensers for holding and administering strip-shaped substances are already known from the state of the art. The strip-shaped substances are usually ingestible, water-soluble strips for oral care or other types of care. Strip-shaped substances are known that are formulated as medications, food supplements, sweets, cosmetic articles or hygiene articles. The strip-shaped substances are often pre-cut into uniform rectangles and are stored in a stack in the housing.

The strip-shaped substances are normally removed from the housing through a removal opening. Here, however, it is a drawback that the removal opening is often relatively small, as a result of which the strip-shaped substances are difficult to remove.

Before this backdrop, U.S. Pat. Appln. Publ. No. 2005/0092763 A1 discloses a dispenser that can be opened by sliding a lid. The strip-shaped substances are pushed in the direction of the removal opening by means of an elevation so that they can be removed.

The strip-shaped substances are often film-like, water-soluble strips that are relatively sensitive to moisture. It is especially problematic that, after some time, the strip-shaped substances absorb moisture, which causes them to degrade and stick together.

A dispenser that is sealed against moisture is disclosed in international application WO 2005/051822 A1. It has a transport bar that rests on the stack of strip-shaped substances when the housing is closed. As a result, however, the sensitive strip-shaped substances can be pressed against each other and can stick together.

It is also problematic that a person who reaches into the removal opening can contaminate the strip-shaped substances that remain in the housing. In particular, when medications are used in the above-mentioned dispensers, germs can be transferred to other users of the dispenser.

U.S. Pat. Appln. Publ. No. 2005/0274733 A1 addresses this problem with a dispenser that ejects the strip-shaped substances out of the housing by means of a sliding procedure. For this purpose, the dispenser has a push-bar that rests on the stack of strip-shaped substances when the housing is closed. With this approach, however, the strip-shaped substances can be pressed against each other and can stick together.

German utility model DE 20119188 U1 and international application WO 2004/024593 A1 each describe a dispenser in which the strip-shaped substances are transported by exerting manual pressure. A transport bar has to be pressed onto the strip-shaped substances by exerting manual pressure in order to transport them. In this process, the pressure applied has to be very precise in order to prevent more than one strip-shaped substance from inadvertently being transported. This problem arises especially if the strip-shaped substances are adhering to each other.

Therefore, there is a need for a dispenser that allows a more reliable and dependable administration of one single strip-shaped substance when the housing is opened. The strip-shaped substance should be administered into the hand or directly into the mouth, without the fingers of the user reaching into the housing or touching the strip-shaped substance. There is a need for such dispensers, especially in medicine, in order to administer medications.

SUMMARY OF THE INVENTION

Therefore, the invention is based on the objective of designing and refining a dispenser of the above-mentioned type in such a manner as to allow a contamination-free and reliable transport of one single strip-shaped substance from the inside of the housing merely by moving the lid.

According to the invention, the present objective is achieved by a dispenser having the features of claim 1. According to this claim, a dispenser of the above-mentioned type is characterized in that the transport bar is elastically pre-tensioned and mounted in the housing in such a way that it is at a distance from the stack when the removal opening is closed.

In the manner according to the invention, it has been recognized that, thanks to the use of a transport bar, a strip-shaped substance can be transported through the removal opening from the inside of the housing, without the fingers having to reach into the inside of the housing. Moreover, it has been recognized that a transport bar that is elastically pre-tensioned can be subjected to force in such a way that, in a defined manner, it pulls individual strips or one individual strip-shaped substance and transports it to the removal opening. Moreover, it has been recognized that the fingers only have to touch the lid in order to move the transport bar and thus one strip-shaped substance. Consequently, the inside of the housing is not contaminated. Finally, it has been recognized that a transport bar that is at a distance from the stack does not press the strip-shaped substances against each other, thereby preventing them from sticking together. Thus, a dispenser is being put forward that transports individual strip-shaped substances to a removal opening of the dispenser contamination-free and reliably.

In order for the transport bar to be at a distance from the stack, it could rest on a spacer when the removal opening is closed. This ensures that, when the housing is closed, the transport bar does not exert any pressure onto the strip-shaped substances. It is ensured that the strip-shaped substances are not pressed against each other and cannot stick together.

When the removal opening is opened, the transport bar could execute a transport stroke to pick up and transport a strip-shaped substance from the stack to the removal opening. Thanks to this concrete embodiment, merely by actuating the lid, the strip-shaped substance can be transported from the inside of the housing to the removal opening in such a way that the strip-shaped substance extends partially out of the removal opening. Therefore, users of the dispenser can then grasp the strip-shaped substance with their fingers, without contaminating the strip-shaped substances that remain in the chamber of the housing.

In this context, the transport bar could travel at least partially underneath a guide track during the transport stroke. Since the transport bar travels underneath a ramp-like guide track, it can come into contact with a rounded-off, bead-like contact surface of the topmost strip-shaped substance of the stack and can carry it along to the removal opening.

At a defined open position of the lid, the transport bar could move underneath a latch in order to come into contact with a launch end of the guide track. In this concrete embodiment, the transport bar travels underneath an elastically deformable latch in such a way that, after an elastic deformation, it moves off the end of the transport bar into its resting position. As a result, the transport bar cannot return along the path it has already traversed. The latch blocks the transport bar from the path it has traversed. In this concrete embodiment, the elastically deformable latch functions analogously to a non-return valve. After the transport bar has moved underneath the latch, it comes into contact with a launch end of a ramp-like guide track.

When the removal opening is being closed, the transport bar could be guided on a guide track inside the housing in such a way that it passes the stack of strip-shaped substances without making contact. When the lid is closed, the transport bar is guided along the ramp-like guide track and it travels a path that is above the path that the transport bar travels when the lid is opened. Since the transport bar is guided on the ramp-like guide track, it is kept at a distance from the stack of strip-shaped substances and does not come into contact with it. This prevents the transport bar from crushing, jamming, folding or crumpling the strip-shaped substances that remain in the housing.

The guide track could be configured as a ramp that is made up of a component that is latched in the housing. The component can be produced separately from the housing and then latched into it inseparably. This makes it possible to design guide tracks with different pitches and lengths, irrespective of the housing. In particular, it is possible to make the component of a material that differs from the material of the housing. In this context, it is concretely conceivable for the component to contain a desiccant or to be made of a desiccant compound. The desiccant absorbs liquid that has penetrated into the housing. This component is also referred to as a tray.

When the removal opening is being closed, the transport bar could move from a traverse end of the guide track onto a spacer due to its elastic pre-tensioning, so that the lid closes the housing. As a result, force can be exerted onto the lid to pull it against the housing so as to create a seal. The elastically deformable transport bar generates a restoring force that is used to pull the lid against the housing so as to create a seal.

In this context, the transport bar could be configured as an elastically deformable element from which side arms project on both sides. The configuration as an elastically deformable element makes it possible to flexibly and reversibly bend the transport bar during the opening procedure and during the closing procedure. For this purpose, the housing could be provided with bending aids that bend the transport bar when the lid is being opened and closed. The projecting side arms allow the transport bar to be guided on a guide track while being bent in the process. The side arms can be guided on the guide track, and, by means of a main branch, the pulling force or the pushing force of the moved lid is transmitted to the side arms.

The lid and the transport bar could be made in one piece, and said lid is joined to the housing via clamping cams. The clamping cams allow the lid to be produced separately and to be joined to the housing inseparably. The lid configured in one piece with the transport bar could be made of a softer material than the housing. In this manner, the lid can have a very good sealing effect when it is pressed against the housing. The penetration of moisture into the inside of the housing is prevented. It is also conceivable for the lid to be made of two components, especially by means of two-component injection-molding.

The clamping cams could be configured in one piece with a rigid part onto which the lid is attached in an articulated manner so as to pivot via a film hinge. In this concrete embodiment, the transport bar can be moved by pivoting the lid. The elastically deformable transport bar is guided by bending aids and follows the curved path of the lid during the opening and closing, namely, when the lid is pivoted around the film hinge.

In this context, it is also conceivable for the lid to execute a translatory motion during the opening and closing of the removal opening. In this context, the lid can be pulled away from the housing or slid into it in the same manner as a drawer. A dispenser with this particular configuration has very flat dimensions and is characterized by its extremely compact shape.

The lid could have an encircling gasket on the side facing the removal opening. The gasket ensures that the removal opening can be sealed so as to be liquid-tight or air-tight when the lid is closed. A dispenser with this configuration can hold moisture-sensitive medications, cosmetics, orally administered scents or hygiene articles. The dispenser can hold active ingredient strips that quickly dissolve in the mouth upon exposure to moisture, but that can be stored in the dispenser for a prolonged time. For this purpose, a desiccant can be present inside the dispenser.

The gasket could be configured as an olive gasket. An olive gasket has a convex bead that engages or snaps into a concave groove. With the olive gasket, the lid can only be separated from the housing with the use of force. The olive gasket is not flat but rather runs inside the housing.

The dispenser could consist of three parts, namely, of three individual parts that are each separately injection-molded. Thanks to this concrete embodiment, the dispenser is easy to manufacture and has only a small number of individual parts that have to be latched to each other or pressed together.

The dispenser described here can hold, for example, tooth-brighteners, food supplements, vitamins, flavorings, fragrances, perfumes, sleeping medications, birth-control products, hormones, appetite suppressants, medications, orally administered scents and electrolytes for athletes.

Moreover, the dispenser can be used to hold skin care products in the tropics, especially sunscreen. The dispenser can also hold soap, cosmetics, paper, especially business cards, or household articles.

Finally, the dispenser described here can hold and transport virtually any thin strips that can be held in a stack in the housing of the dispenser. The dimensions of the strips are preferably 23 mm in width and 28 mm in length.

The dispenser described here is characterized by its very compact form and it fits, for example, in pant pockets or handbags. Moreover, it is easy to use since merely opening the lid is sufficient in order to transport a strip-shaped substance.

Strip-shaped substances can be administered to people who cannot swallow pills. The dispenser is a very good modality of oral administration for children and the elderly. The strip-shaped substances allow a rapid transport of the active ingredients through the mucous membranes. Here, it is conceivable to design the dispenser so as to be childproof.

The dispenser described here provides a cost-efficient administration form and can transport up to 65 mg of active ingredients.

BRIEF DESCRIPTION OF THE DRAWINGS

Additional objectives, features, advantages and application possibilities of the present invention ensue from the description below of embodiments making reference to the drawing. In this context, all of the described and/or depicted features on their own or in any desired combination are the subject matter of the invention, irrespective of their compilation in the individual claims and those to which they refer back.

The drawing shows the following.

DETAILED DESCRIPTION OF THE INVENTION

Figure 1:
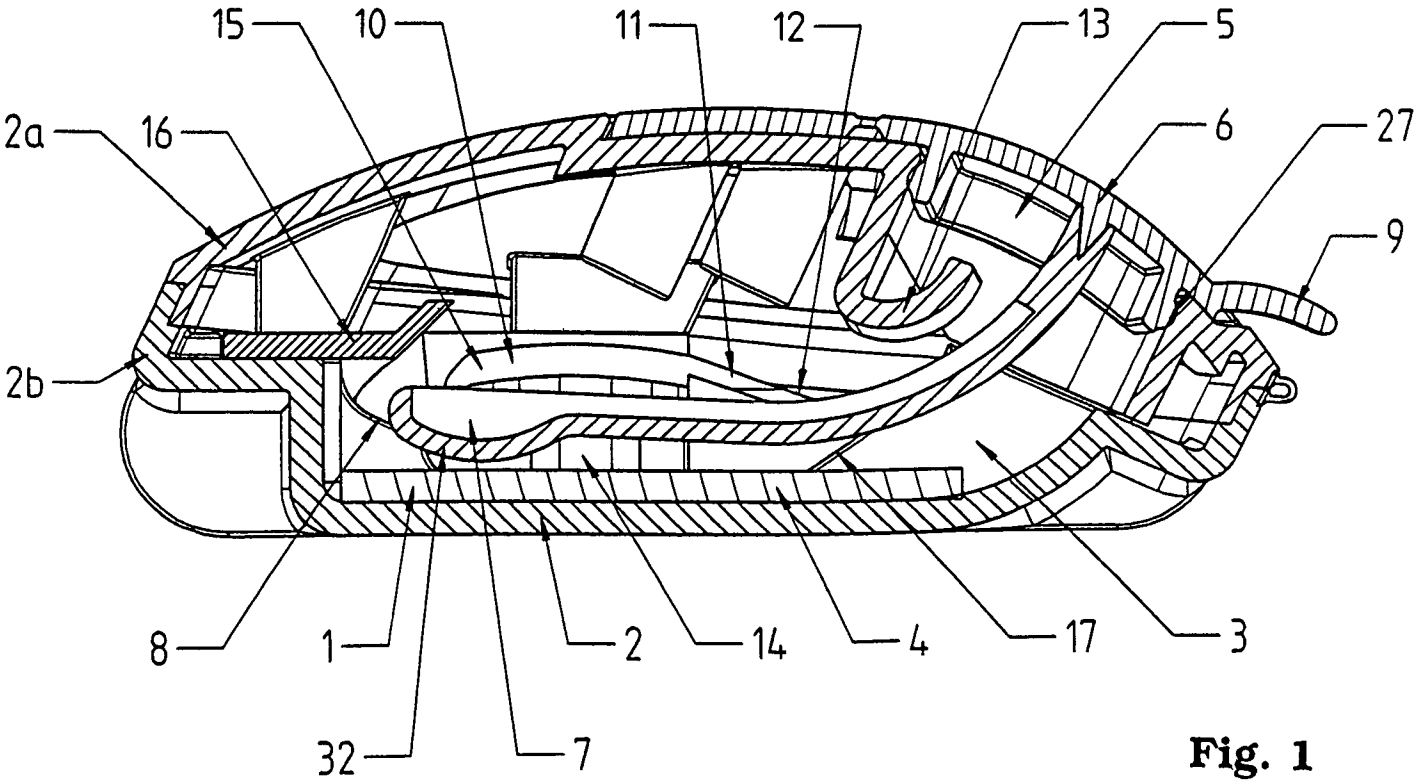
FIG. 1 a sectional view of a closed dispenser with a curved housing.

In FIGS. 1 through 15, the same reference numerals designate the same elements of the dispenser being shown.

FIG. 1 shows a dispenser for administering strip-shaped substances 1, comprising a housing 2, wherein said housing 2 has a chamber 3 to store a stack 4 of the strip-shaped substances 1, said housing 2 forming a removal opening 5 for the strip-shaped substances 1 that can be opened and closed again by a lid 6, and said lid 6 being joined to the housing 2. The lid 6 is joined to a transport bar 7 that can be moved together with the lid 6 in order to transport the strip-shaped substances 1. The transport bar 7 is elastically pre-tensioned and mounted in the housing 2 in such a way that it is at a distance from the stack 4 when the housing 2 or the removal opening 5 is closed.

When the lid 6 is closed, the transport bar 7 rests on a spacer 8 in order to be held at a distance from the stack 4. The spacer 8 is configured as a spacer bevel. A handle 9 is configured on the lid 6 so that the lid 6 can be gripped.

Figure 2:
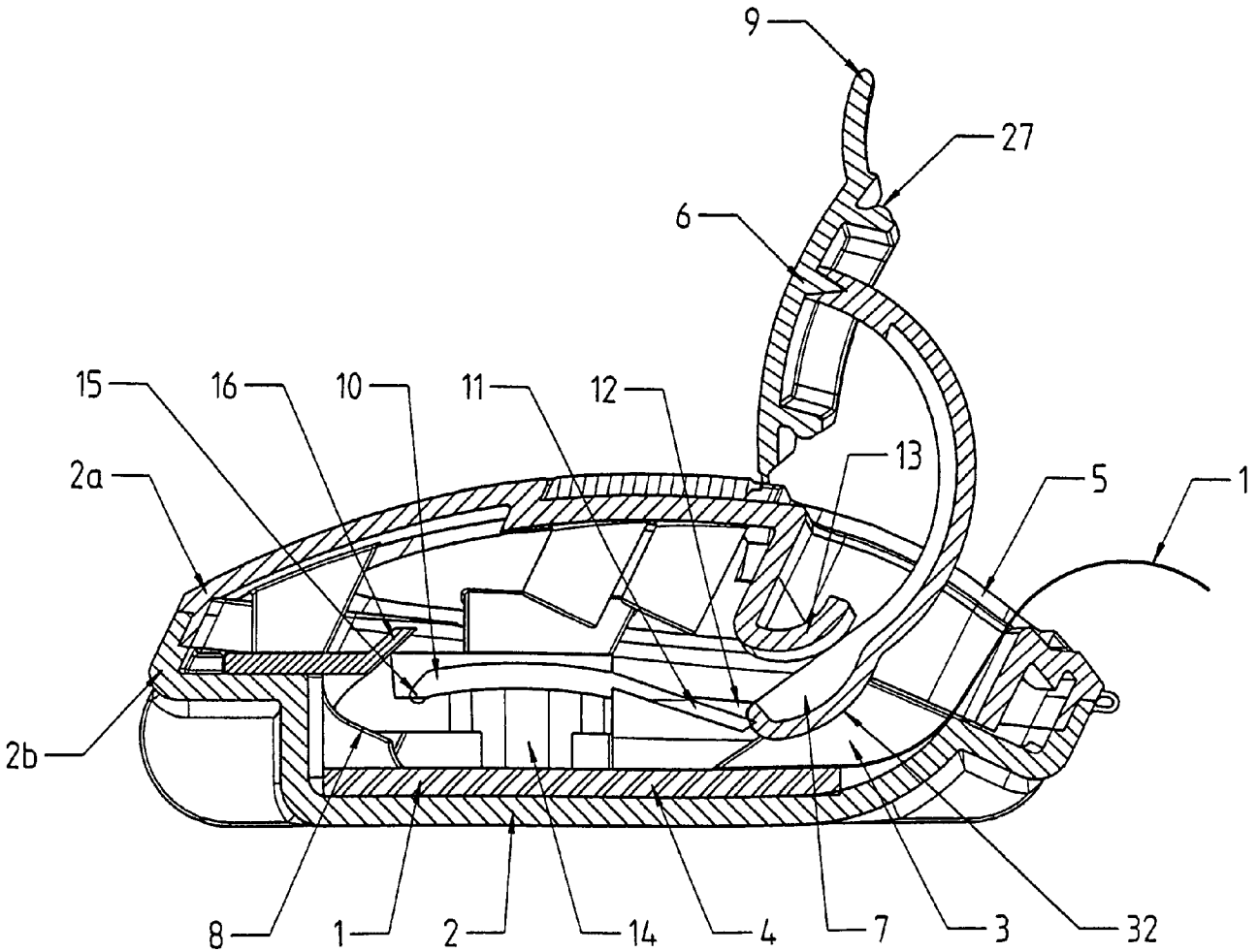
FIG. 2 a sectional view of the housing according to FIG. 1, wherein the lid is open, FIG. 3 a sectional view of the housing according to FIG. 1, wherein the lid is executing a closing movement, FIG. 4 a perspective view of the housing of the dispenser according to FIG. 1, consisting of a top part and a bottom part, FIG. 5 a perspective view of the transport bar and of the lid that is connected to it in one piece, FIG. 6 a perspective view of the component that has a guide track and that can be latched onto the bottom part of the housing according to FIG. 4, FIG. 7 a perspective view of the three individual parts of FIGS. 4 and 5 in an exploded view of the dispenser according to FIG. 1, FIG. 8 a perspective view of the dispenser according to FIG. 1 with an open lid, FIG. 9 three views of the closed dispenser according to FIG. 1, FIG. 10 a sectional view of a closed dispenser whose lid can be moved by a translatory, namely, axial, motion, FIG. 11 a sectional view of the dispenser according to FIG. 10, with an open lid, FIG. 12 a perspective view of the three individual parts that make up the dispenser according to FIG. 10, FIG. 13 a perspective view of the component that is immovably latched to the housing of the dispenser according to FIG. 10, FIG. 14 a perspective view of the lid of the dispenser according to FIG. 10, and FIG. 15 three views of the dispenser according to FIG. 10.

FIG. 2 shows a sectional view of the dispenser according to FIG. 1 with the lid 6 open. When the lid 6 is opened, the transport bar 7 executes a transport stroke to pick up and transport the strip-shaped substance 1 from the stack 4 to the removal opening 5. The strip-shaped substance 1 that is advanced by the transport bar 7 when the lid 6 is opened projects from the removal opening 5 and can be grasped with the fingers. The transport bar 7 attached in an articulated manner onto the lid 6 in such a way that it essentially prevent fingers from reaching into the removal opening 5.

During the transport stroke, the transport bar 7 travels at least partially underneath a guide track 10, that is to say, on the side of the guide track 10 facing the stack 4, while bending. At a defined open position of the lid 6, the transport bar 7 travels underneath a latch 11 and consequently comes into contact with a launch end 12 of the guide track 10.

Figure 3:
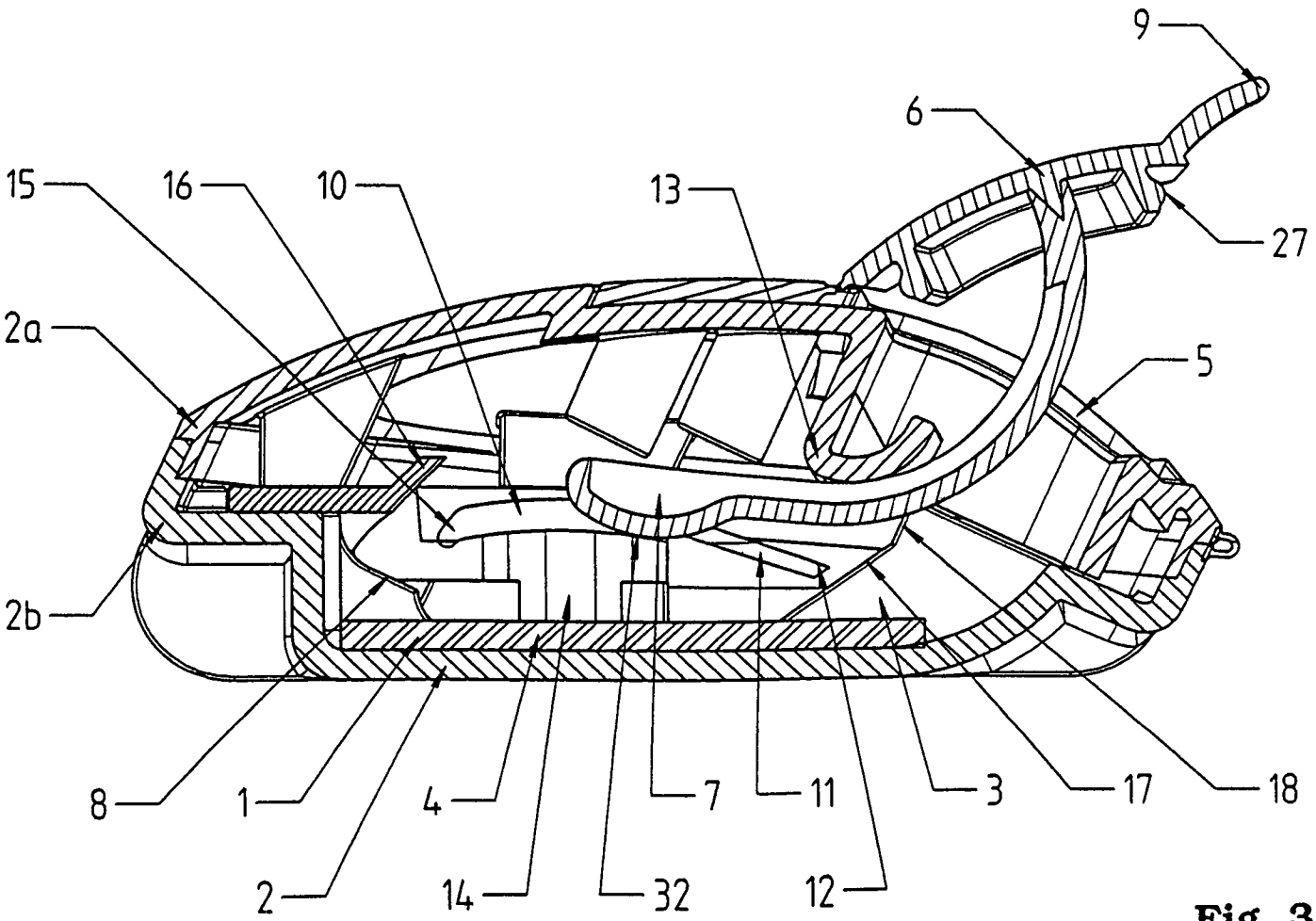

FIG. 3 shows a sectional view of the dispenser according to FIG. 1 in which the lid 6 is making a closing movement. When the lid 6 is being closed, the transport bar 7 is guided on a guide track 10 inside the housing 2 in such a way that it passes the stack 4 of strip-shaped substances 1 without making contact and so that it is moved above said stack 4 at a distance. The transport bar 7 is bent by a first bending aid 13 and by the guide track 10 under elastic pre-tensioning.

The guide track 10 is configured as a ramp and configured on a component 14 that is latched in the housing 2. The component is also referred to as a tray.

When the lid 6 is being closed, the transport bar 7 moves from a traverse end 15 of the guide track 10 onto a spacer 8 due to the curvature, so that the lid 6 closes the housing 2. In this process, the transport bar 7 is guided downwards onto the spacer 8 by means of a second bending aid 16.

The lid 6 executes a pivoting motion during the opening and closing of the removal opening 5. When the lid 6 is opened, the elastically deformable transport bar 7 is bent by the first bending aid 13 and by a third bending aid 17, while the third bending aid 17 guides the transport bar 7 to a stop 18. When the lid 6 is being closed, the elastically deformable transport bar 7 is bent by the first bending aid 13 and by the ramp-like guide track 10. The second bending aid 16 forces the transport bar 7, which is under elastic pre-tensioning, onto the spacer 8 when the lid 6 is being closed. The stop 18 prevents the elastic transport bar 7 from being pulled beyond a defined pull-out position and out of the housing 2 when the lid 6 is being opened.

Figure 4:
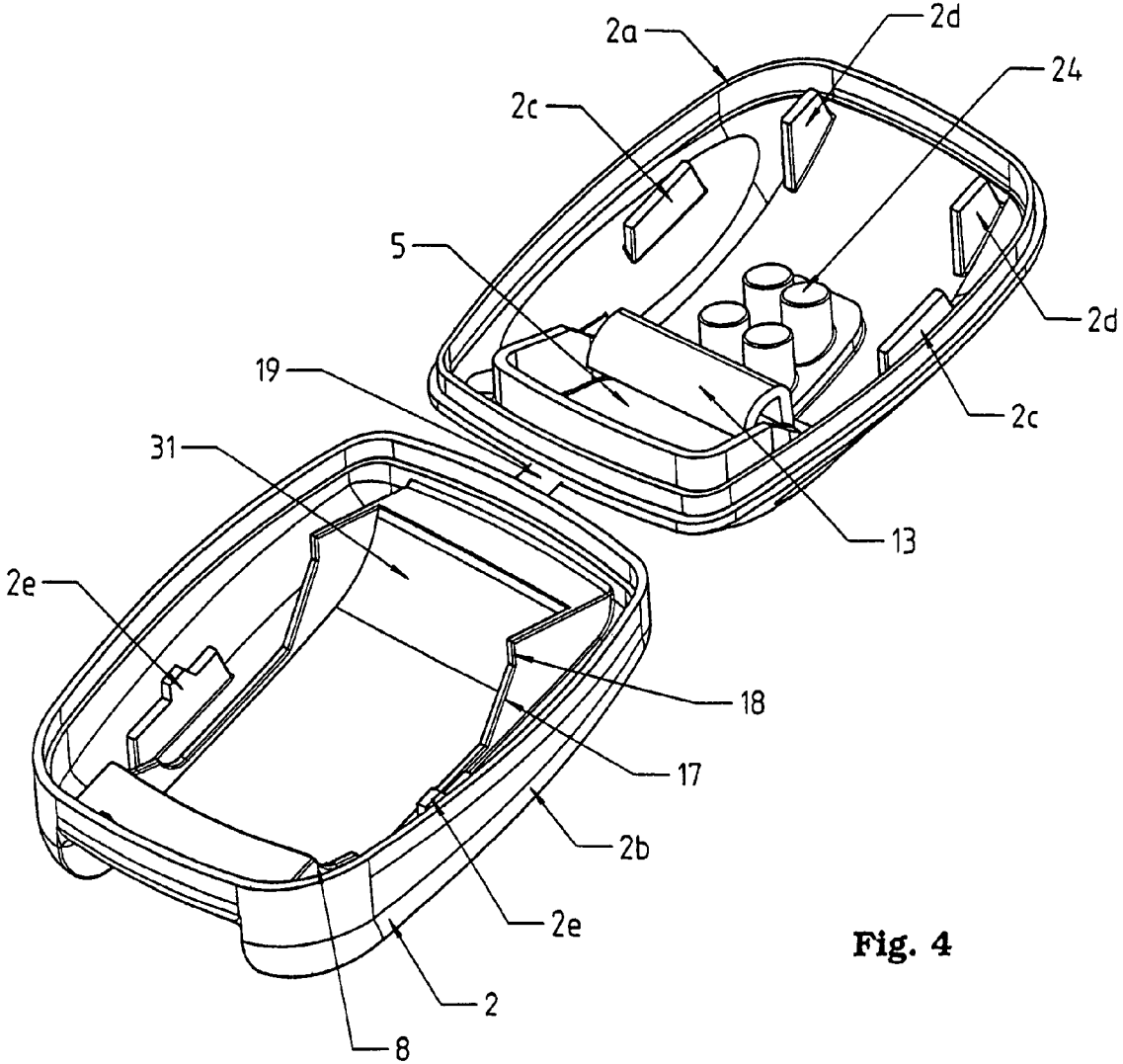

FIG. 4 shows a perspective view of the housing 2 of the dispenser according to FIGS. 1 and 3. The housing 2 is made of plastic by means of injection-molding and it consists of a top part 2*a* and a bottom part 2*b*. The top part 2*a* and the bottom part 2*b* are attached in an articulated manner to each other by means of a connection web 19 that is configured as a film hinge. In the top part 2*a*, there is a removal opening 5 through which the transport bar 7 can pass. The top part 2*a* also has the first bending aid 13, which is configured as an essentially L-shaped, U-shaped or hook-shaped curved tongue. The end of the tongue projects in the direction of the removal opening 5. Finally, two component holders 2*c*, 2*d* are configured on both sides of the top part 2*a* in order to hold the component 14.

The third bending aid 17 is formed in the bottom part 2*b*. It is followed by the stop 18. The third bending aid 17 and the stop 18 are arranged on two sides of the bottom part 2*b*. Furthermore, the spacer 8, which is configured as a spacer bevel, is configured in the bottom part 2*b*. The spacer 8 is configured as a two-stage spacer bevel with two differently curved slanted stages.

Furthermore, a strip guide 31 is formed in the bottom part 2*b*. The strip guide 31 has a ramp-like design and it guides the strip-shaped substances 1 to the removal opening 5. Web-like projections 2*e* are also configured on two sides in the bottom part 2*b*, and the component 14 can be placed onto said web-like projections 2*e*. The housing 2 is configured in such a way that it can be de-molded from an injection mold without a sliding split.

Figure 5:
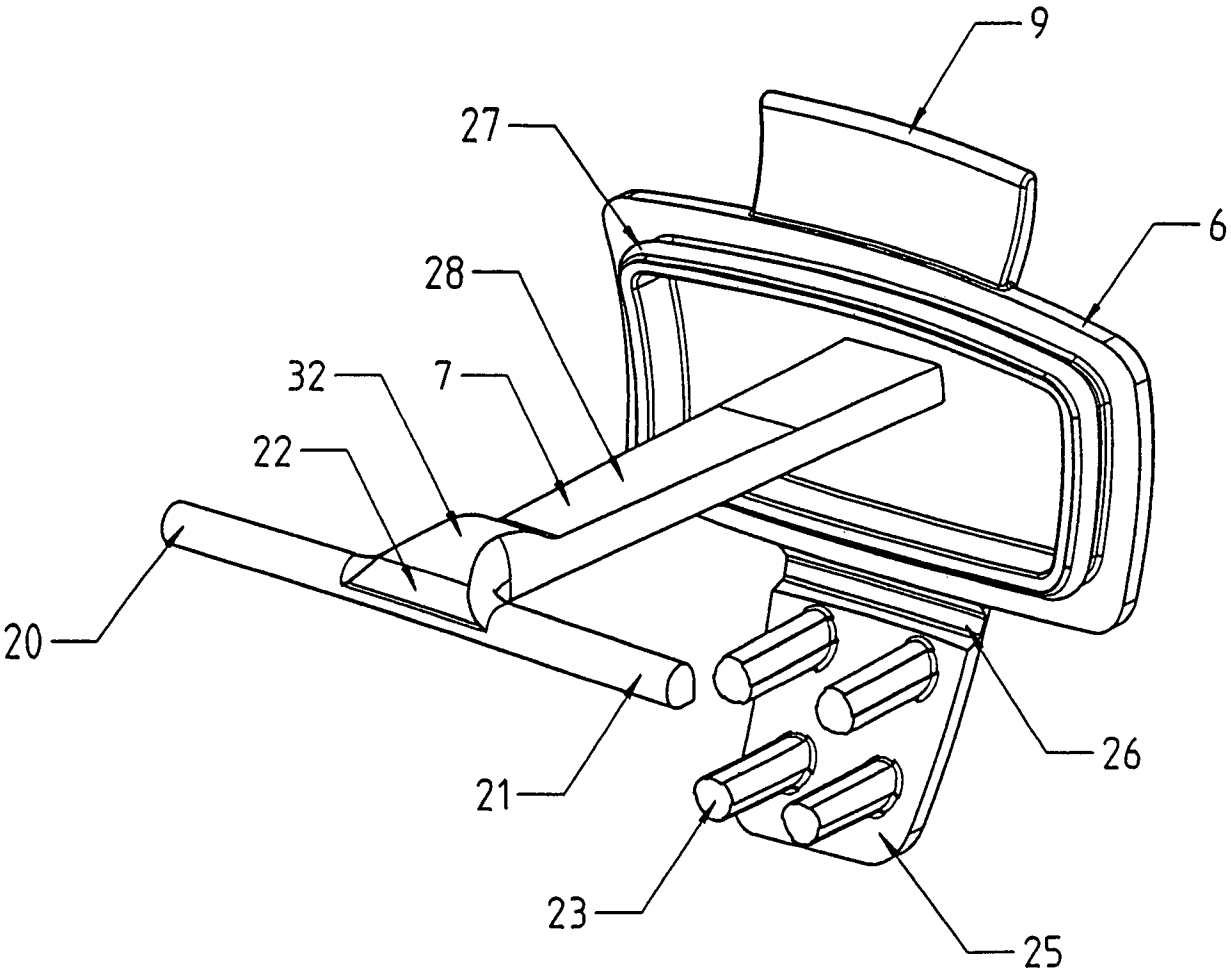

FIG. 5 shows a perspective view of the lid 6 that is configured in one piece with the transport bar 7. The transport bar 7 is configured as an elastically deformable element from which side arms 20, 21 project on both sides. The side arms 20, 21 project from the end 22 of the transport bar 7. The lid 6 is pressed onto the housing 2 by means of clamping cams 23. To put it in concrete terms, four clamping cams 23 engage into four receptacles 24 for the clamping cams 23 in the top part 2*a*. Therefore, the lid 6 is joined to the top part 2*a* of the housing 2 so as to be inseparable. The clamping cams 23 are configured in one piece with a rigid part 25 onto which the lid 6 is attached in an articulated manner so as to pivot on a film hinge 26.

The lid 6 has an encircling gasket 27 on the side facing the removal opening 5. The gasket 27 is configured as an olive gasket. The transport bar 7 has a main branch 28 that is elastically deformed and bent by the first bending aid 13 and by the third bending aid 17. By means of the second bending aid 16, the end 22 of the transport bar 7, from which the side arms 20, 21 project, is forced onto the spacer 8. The side arms 20, 21 are guided on the ramp-like guide track 10.

At the end 22 of the transport bar 7, there is a bead-like contact surface 32 that comes into contact with the strip-shaped substances 1 when they are carried along.

It is also conceivable to make the lid 6 by means of two-component injection-molding or in two parts of different components.

Figure 6:
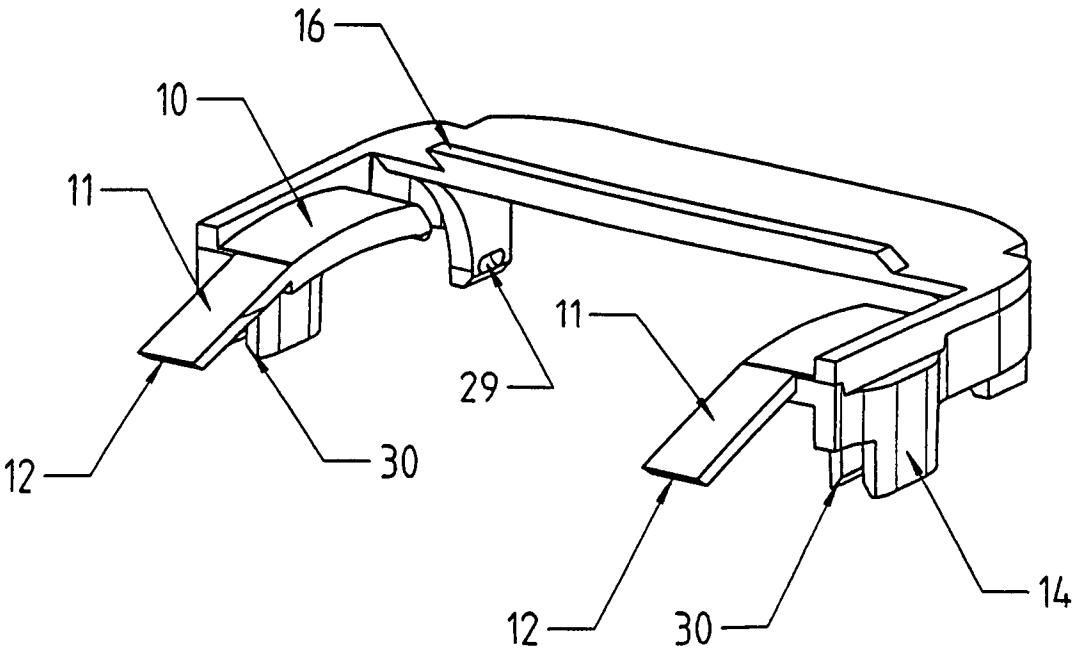

FIG. 6 shows the component 14 that is latched to the bottom part 2*b* of the housing 2 by means of mounting latches 29 that are configured as indentations. The component 14 also has fork-like centering aids 30 that grip around web-like projections 2*e* in the bottom part 2*b* of the housing 2. The mounting latches 29 and the centering aids 30 are configured on two sides of the component 14. The component 14 also has the ramp-like guide track 10 on which the side arms 20, 21 of the transport bar 7 are guided. Part of the guide track 10 is the latch 11 that is configured as an elastically deformable tongue. The latch 11 has a launch end 12 on the guide track 10 over which the side arms 20, 21 of the transport bar 7 are guided on the guide track 10. Due to this guidance of the side arms 20, 21, the transport bar 7 is guided past the stack 4 without making contact. Moreover, the second bending aid 16 is configured on the component 14, and, by means of this second bending aid 16, the end 22 of the transport bar 7, from which the side arms 20, 21 project, is forced onto the spacer 8.

Figure 7:
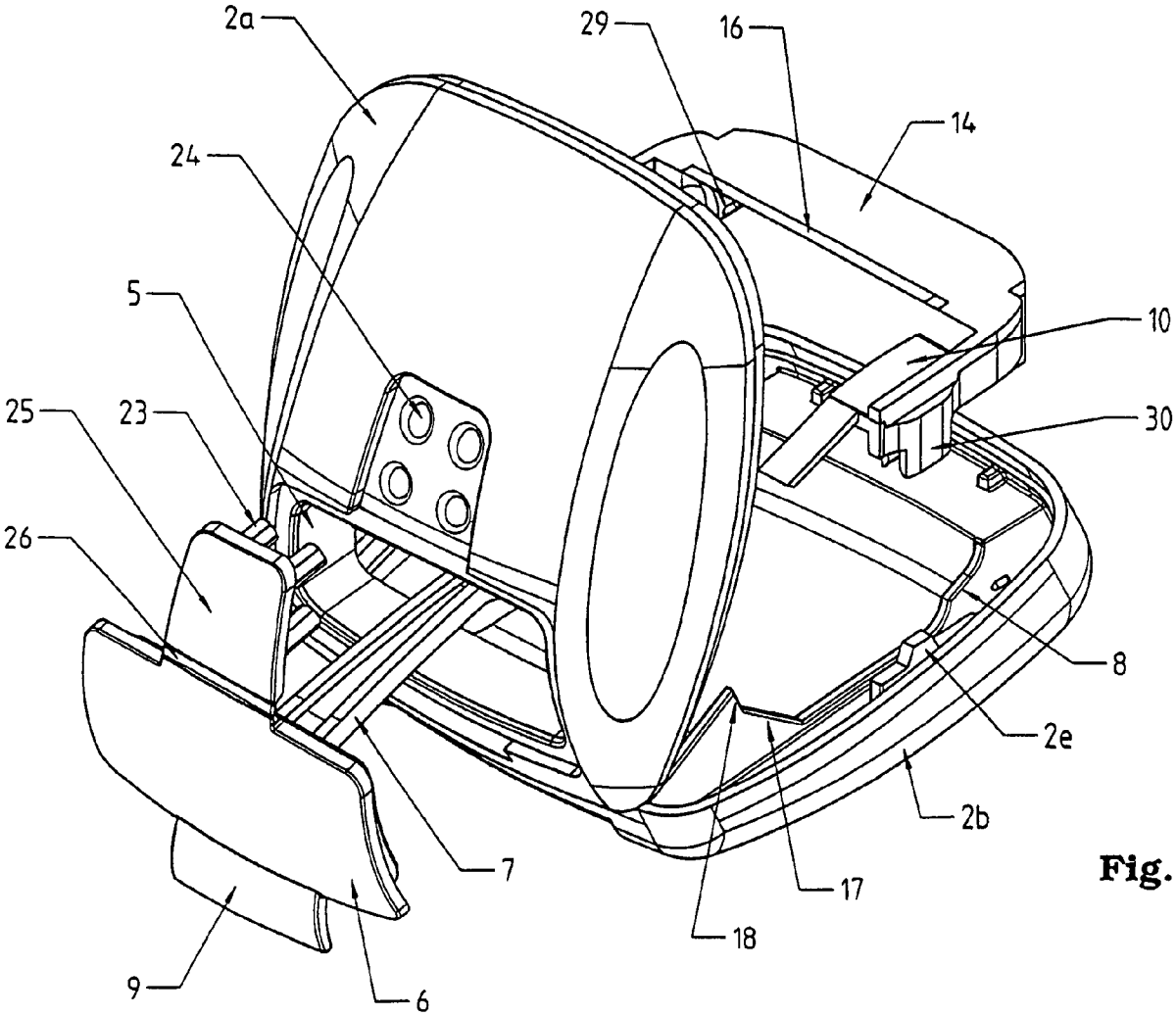

FIG. 7 shows a perspective exploded view of the three individual parts that make up the dispenser according to FIG. 1. In order to produce the dispenser, the component 14 that is injection-molded out of plastic, i.e. the tray, is inserted into the bottom part 2*b* of the housing 2 by being latched. Then the bottom part 2*b* is filled with the strip-shaped substances 1. Subsequently, the lid 6 is pressed into the top part 2*a* by means of the clamping cams 23.

The transport bar 7 has to be mounted under pre-tensioning so that it can exert sufficient pressure onto the strip-shaped substances 1 in order to carry them along and transport them. During the mounting of the lid 6, the transport bar 7 is placed onto the guide track 10.

Then the top part 2*a* and the bottom part 2*b* are joined. During this mounting step, care should be taken to make sure that the transport bar 7 does not slip off the guide track 10. When this mounting step is being carried out, the transport bar 7 moves onto the spacer 8. The permanent joining of the top part 2*a* to the bottom part 2*b* can, if desired, be carried out by ultrasonic welding or friction welding of smooth adjacent joining surfaces or else by adhesion.

The dispenser is completely assembled and prepared to administer the strip-shaped substances 1. Each time after a strip-shaped substance 1 has been transported, the transport bar 7 moves back onto the spacer 8 when the lid 6 is closed, so that it can once again start off from there when the lid 6 is opened. The elastic pre-tensioning of the transport bar 7 with which it makes contact with the stack 4 has to be selected in such a way that even the last strip-shaped substance 1 that remains on the stack 4 is still reliably transported to the removal opening 5.

Figure 8:
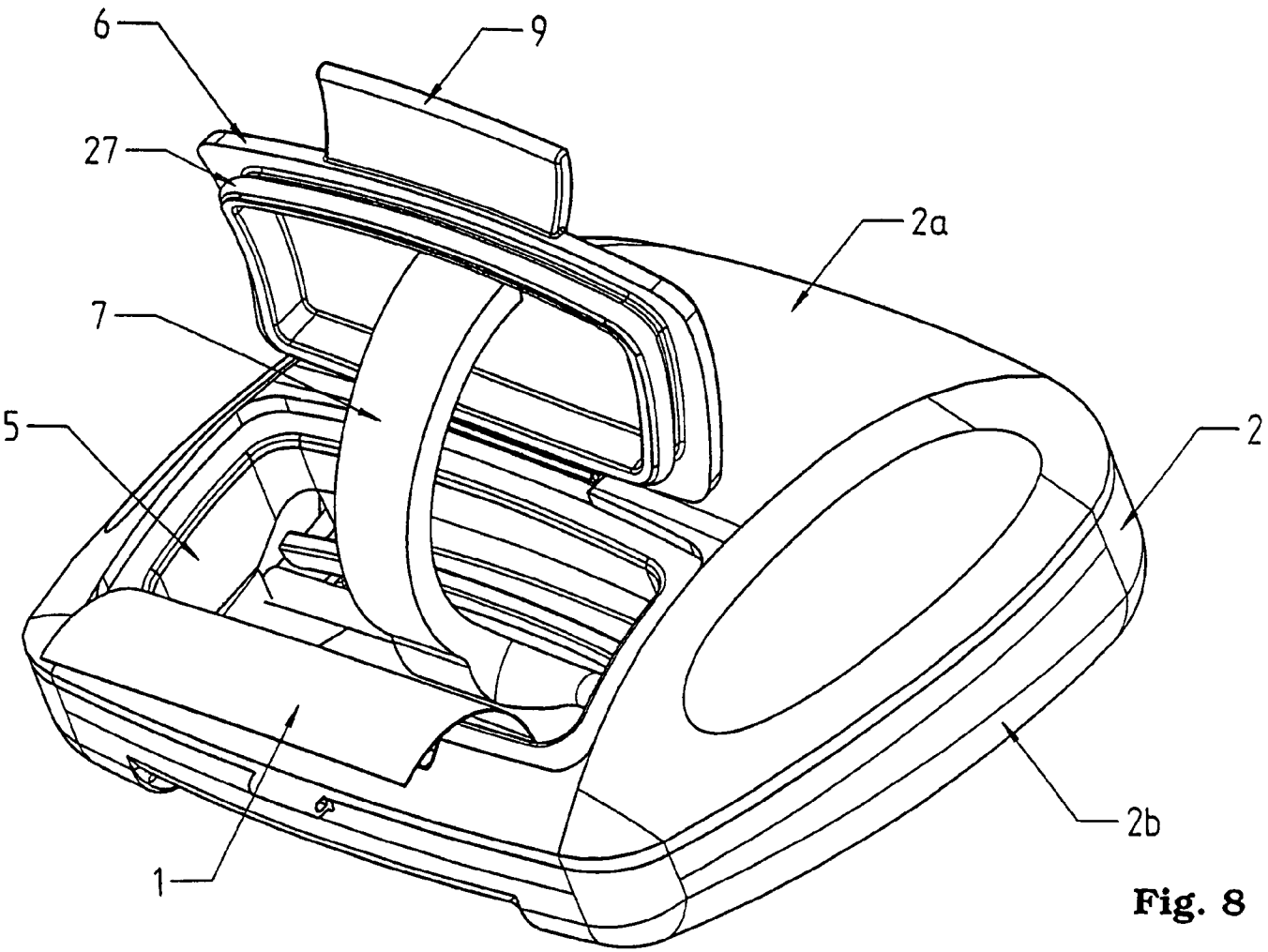

FIG. 8 shows a perspective view of the dispenser with an open lid 6. A strip-shaped substance 1 in the form of a strip projects from the removal opening 5. The transport bar 7 passes through the removal opening 5 in such a way that it is extremely difficult to reach into the inside of the housing 2. This effectively prevents contamination of the strip-shaped substances 1 inside the housing 2. The olive gasket 27 on the lid 6 seals the housing 2 liquid-tight and gas-tight vis-à-vis the atmosphere.

Figure 9:
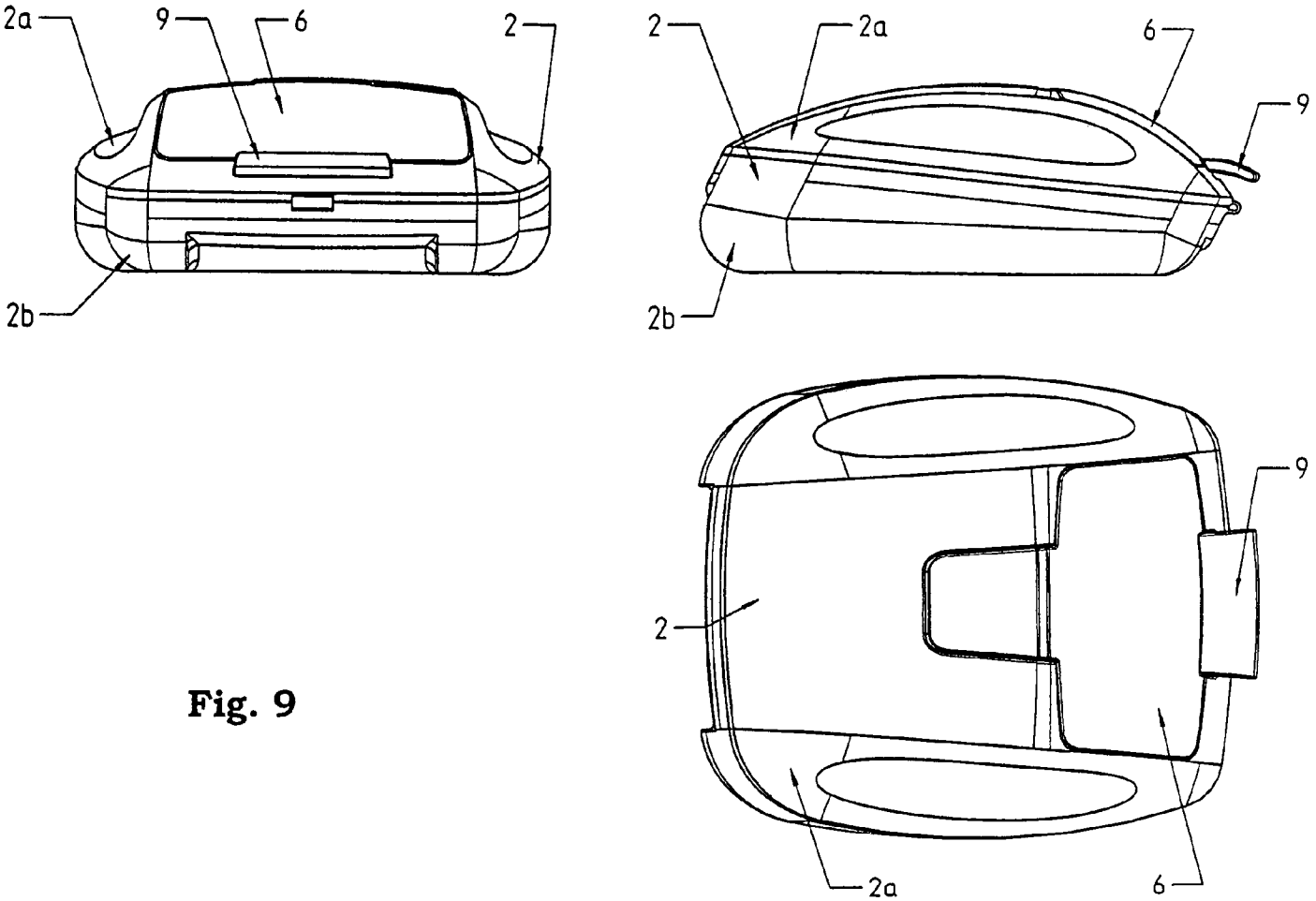

FIG. 9 shows three views of the closed dispenser according to FIG. 1. The view on the upper left in FIG. 9 shows a view of the lid 6 in the direction of the longitudinal axis of the housing 2. The view on the upper right in FIG. 9 shows a side view of the dispenser. The view on the lower right in FIG. 9 shows a top view of the lid 6 of the dispenser.

Figure 10:
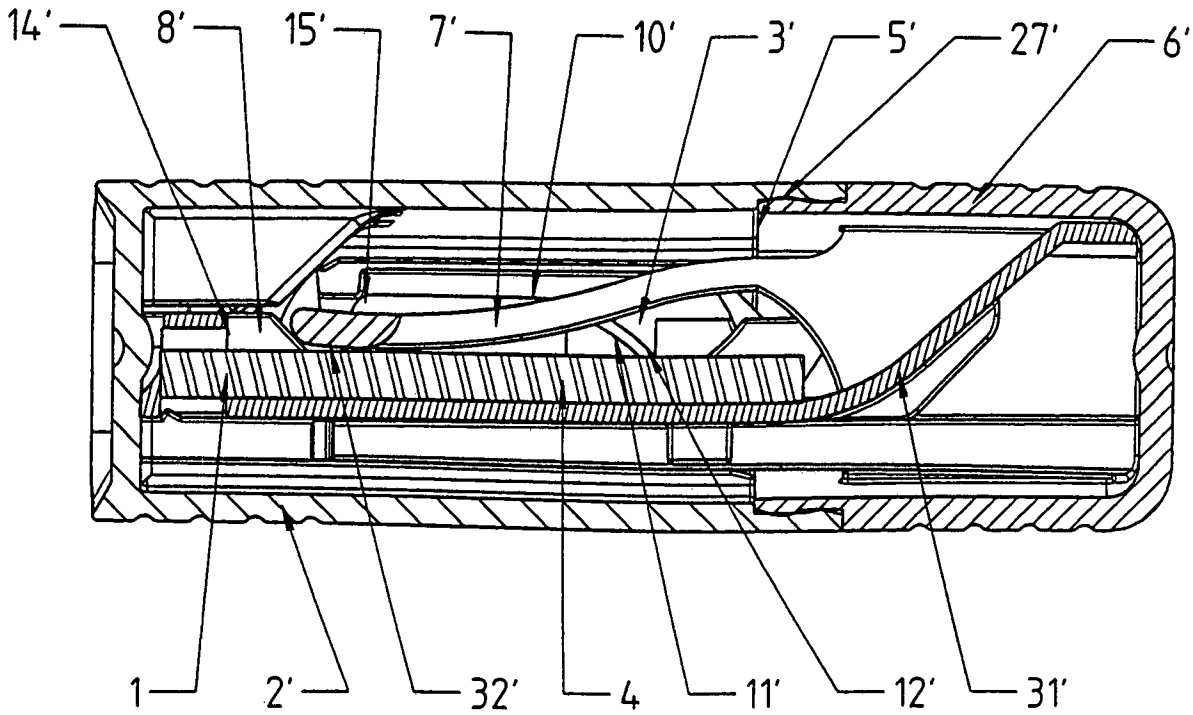

FIG. 10 shows another embodiment of a dispenser for administering strip-shaped substances 1, comprising a housing 2', said housing 2' having a chamber 3' to store a stack 4 of the strip-shaped substances 1, said housing 2' forming a removal opening 5' for the strip-shaped substances 1 that can be opened and closed again by a lid, and said lid 6' being joined to the housing 2'. The lid 6' is joined to a transport bar 7' that can be moved together with the lid 6' in order to transport the strip-shaped substances 1. The transport bar 7' is elastically pre-tensioned and mounted in the housing 2' in such a way that it is at a distance from the stack 4 when the housing 2' or the removal opening 5' is closed.

When the lid 6' is closed, the transport bar 7' rests on a spacer 8' in order to be held at a distance from the stack 4. Its bead-like, rounded-off contact surface 32' does not touch the stack 4.

Figure 11:
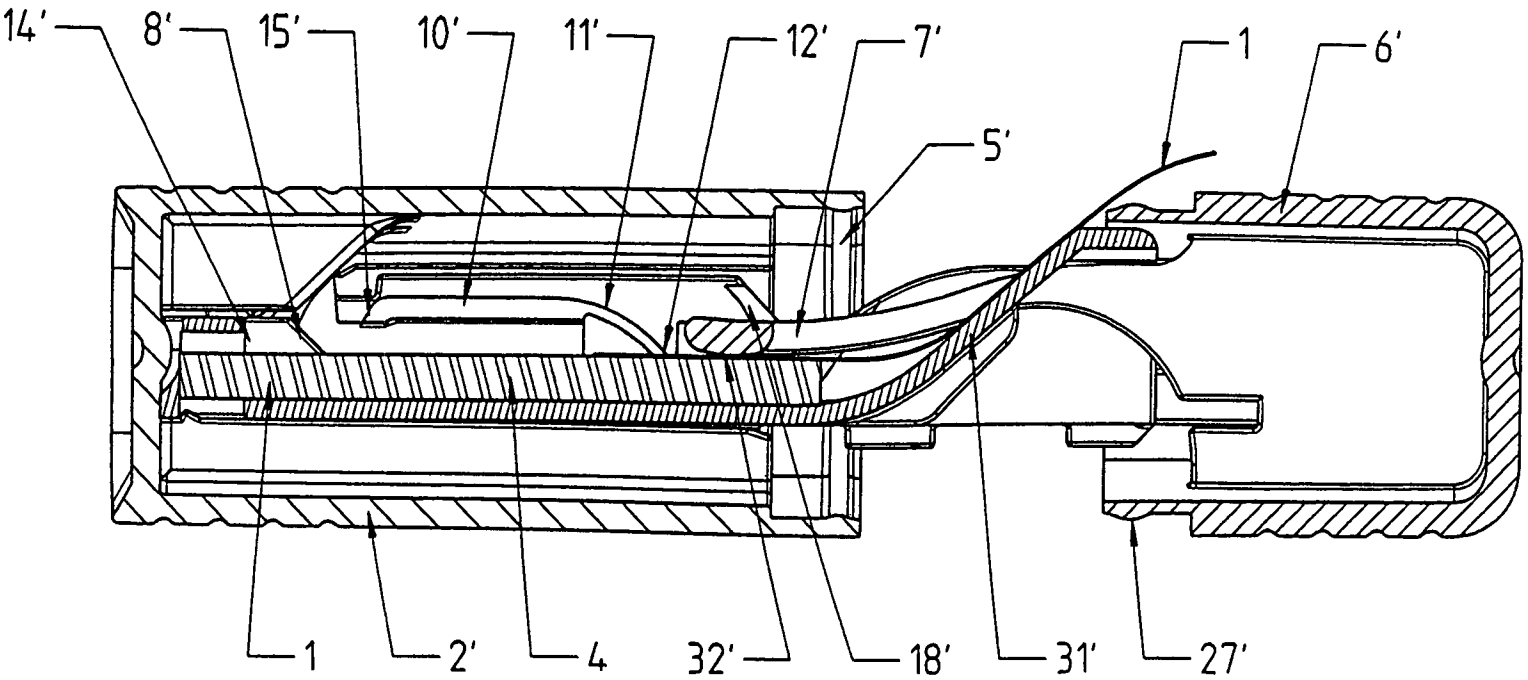

FIG. 11 shows the dispenser according to FIG. 10 with an open lid 6'. When the lid 6' is opened, the transport bar 7' executes a transport stroke to pick up and transport the strip-shaped substance 1 from the stack 4 to the removal opening 5'. The strip-shaped substance 1 projects from the removal opening 5' so that it can be grasped by the fingers. The strip-shaped substance 1 rests on a strip guide 31' that has a straight section and a curved section. The curved section guides the strip-shaped substance 1 upwards out of the removal opening 5' so that it can be grasped by the fingers without any problem.

When the lid 6' is opened, the transport bar 7' executes a transport stroke to pick up and transport the strip-shaped substance 1 from the stack 4 to the removal opening 5'. In this process, the transport bar 7', which is elastically pre-tensioned, travels at least partially underneath a guide track 10', and its contact surface 32' comes into contact with the topmost strip-shaped substance 1 of the stack 4.

At a defined open position of the lid 6', the transport bar 7' travels underneath an elastic, tongue-like latch 11' and consequently comes into contact with a launch end 12' of the guide track 10'. When the transport bar 7' travels underneath the guide track 10', its contact surface 32' is resting on the stack 4 under elastic pre-tensioning. The elastic pre-tensioning of the transport bar 7' always has to be selected in such a way that even the last strip-shaped substance 1 is removed from the stack 4. This ensures that the dispenser will be completely emptied. The explanations relating to the contact surface 32' as well as to the pre-tensioning of the transport bar 7' for ensuring the complete emptying also apply to the dispenser according to FIG. 1.

When the lid 6' is closed, the transport bar 7' is guided on the guide track 10' inside the housing 2' in such a way that it passes the stack 4 of strip-shaped substances 1 without making contact.

The guide track 10' is configured as a ramp that is configured on a component 14' that is latched in the housing 2'. The component 14' is also referred to as a tray. The component 14' is produced separately from the housing 2' and the lid 6', and is latched to the housing 2' for mounting purposes.

Due to the curvature and elastic pre-tensioning of the lid 6', when the lid 6' is closed, the transport bar 7' moves from a traverse end 15' of the guide track 10' onto a spacer 8' because of the curvature, so that the lid 6' closes the housing 2'. In this process, the transport bar 7' is forcibly guided by a bending guide 16'.

The lid 6' executes a translatory motion during the opening and closing of the removal opening 5'. It can be seen in FIG. 11 that the lid 6' executes a translatory, namely, axial, motion relative to the housing 2'. The lid 6' runs in the housing 2' in the manner of a drawer and, facing its removal opening 5', it has a gasket 27' that is configured as an olive gasket.

Figure 12:
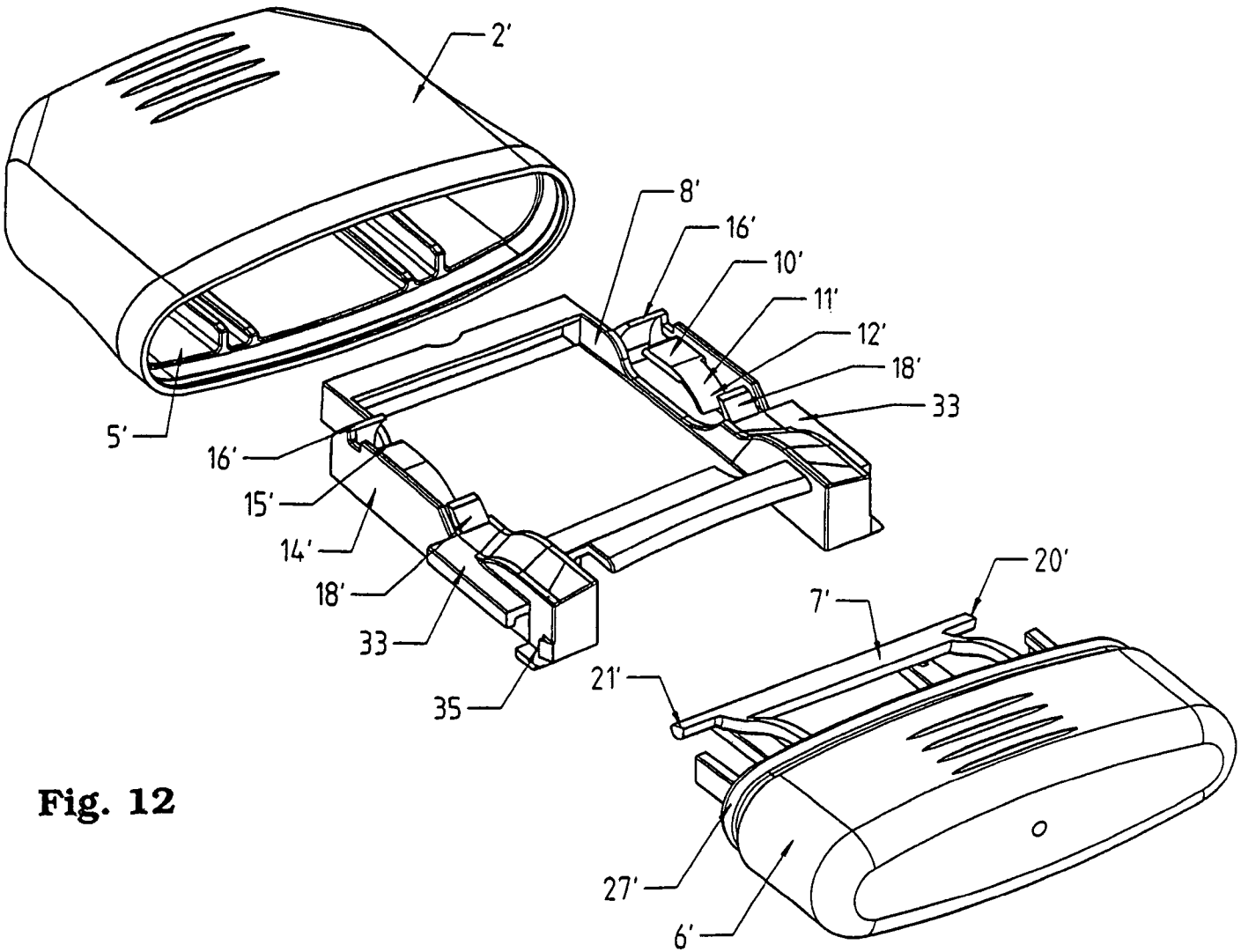

FIG. 12 shows an exploded view of the dispenser according to FIG. 10. FIG. 12 shows that the dispenser according to FIG. 10 has a three-part structure. Each of its three individual parts is made of injection-molded plastic.

The lid 6' and the transport bar 7' are configured in one piece. The transport bar 7' is configured as an elastically deformable element from which side arms 20', 21' project on both sides.

The component 14' can be latched to the housing 2'. The guide track 10' is formed in the component 14'. Moreover, the spacer 8', which is configured as a spacer bevel, is formed in the component 14'. The guide track 10' is associated with the latch 11'. Moreover, in the component 14', there is a stop 18' into which the side arms 20', 21' can engage. The stop 18' has hook-like tabs arranged on both sides, into which the side arms 20', 21' can engage. In this manner, it can be prevented that the lid 6' is pulled beyond a defined open position.

Only after the transport bar 7' has arrived at the stop 18' and has traveled underneath the latch 11' can the transport bar 7' be guided on the guide track 10' above the stack 4 without making contact. Then the transport bar 7' moves from the traverse end 15' onto a spacer 8' under the effect of a bending guide 16', and it rests there until the lid 6' is opened again. The hook-like bending guide 16' forces the transport bar 7' onto the spacer 8'. The bending guide 16' is configured on both sides in the component 14'. The bending guide 16' is configured in the form of curved hooks extending upwards.

Furthermore, the component 14' has the strip guide 31' that guides the strip-shaped substances 1 to the removal opening 5'.

In order to mount the dispenser according to FIG. 10, the component 14' is inserted into the housing 2' of the container by being latched. The component 14' is secured so that it cannot move relative to the housing 2'. Once this has been done, the component 14' can be filled with the stack 4'. Then the lid 6' is mounted. For this purpose, the transport bar 7' has to be placed onto the guide track 10'. As described above, the transport bar 7' moves from a traverse end 15' on the guide track 10' when the lid 6' is latched to the component 14'. The housing 2' or the removal opening 5' is closed when the lid 6' is latched to the component 14'. The olive gasket 27' on the lid 6' ensures that the housing 2' is sealed liquid-tight and gas-tight.

L-shaped guide rails 33 are configured on both sides of the component 14', and guide webs 34 on the lid 6' can enter these L-shaped guide rails 33. The lid 6' is latched to the component 14' by the latching tabs 35 arranged on both sides, and said lid 6' can be slid relative to the housing 2' and relative to the component 14'.

Figure 13:
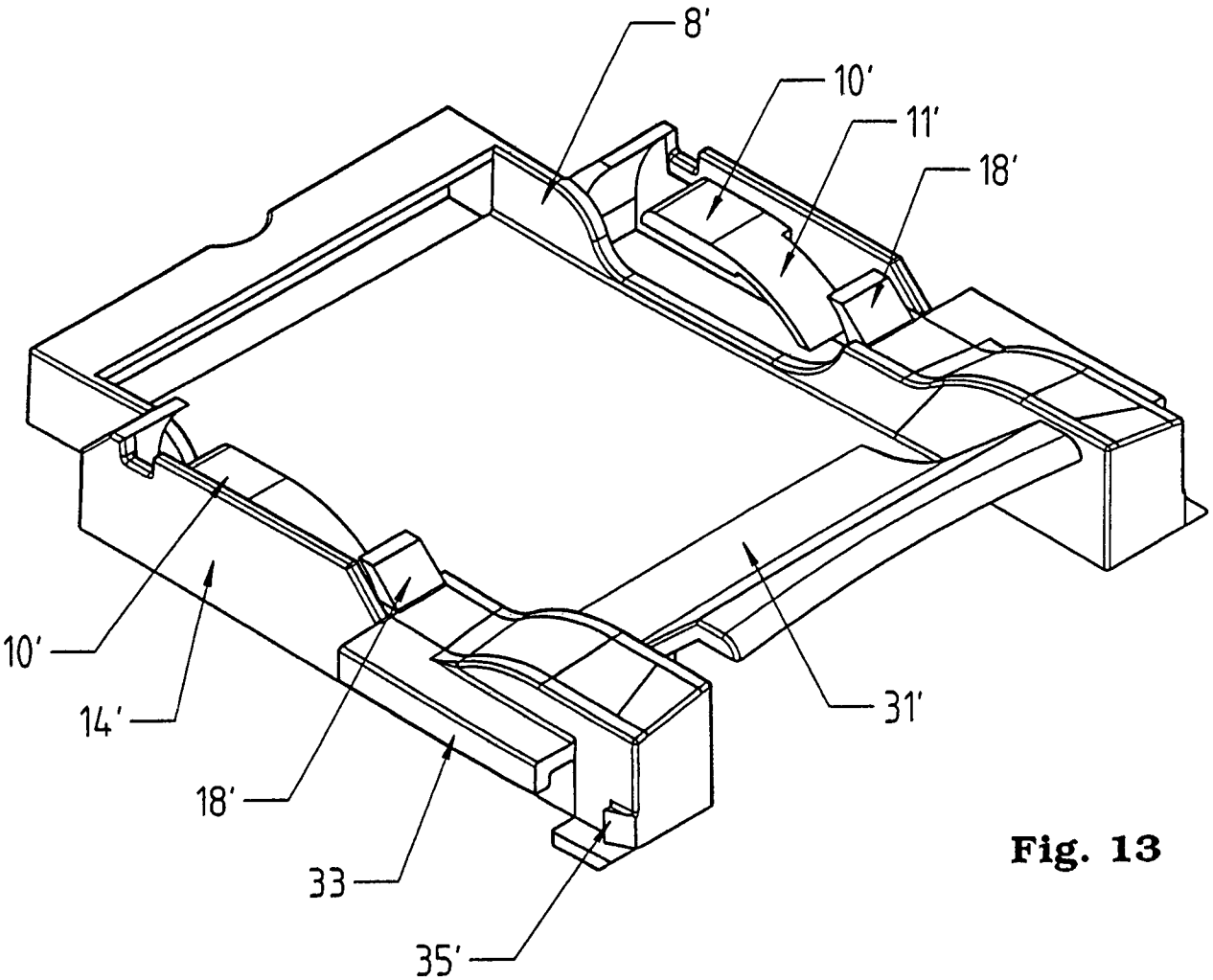
Figure 14:
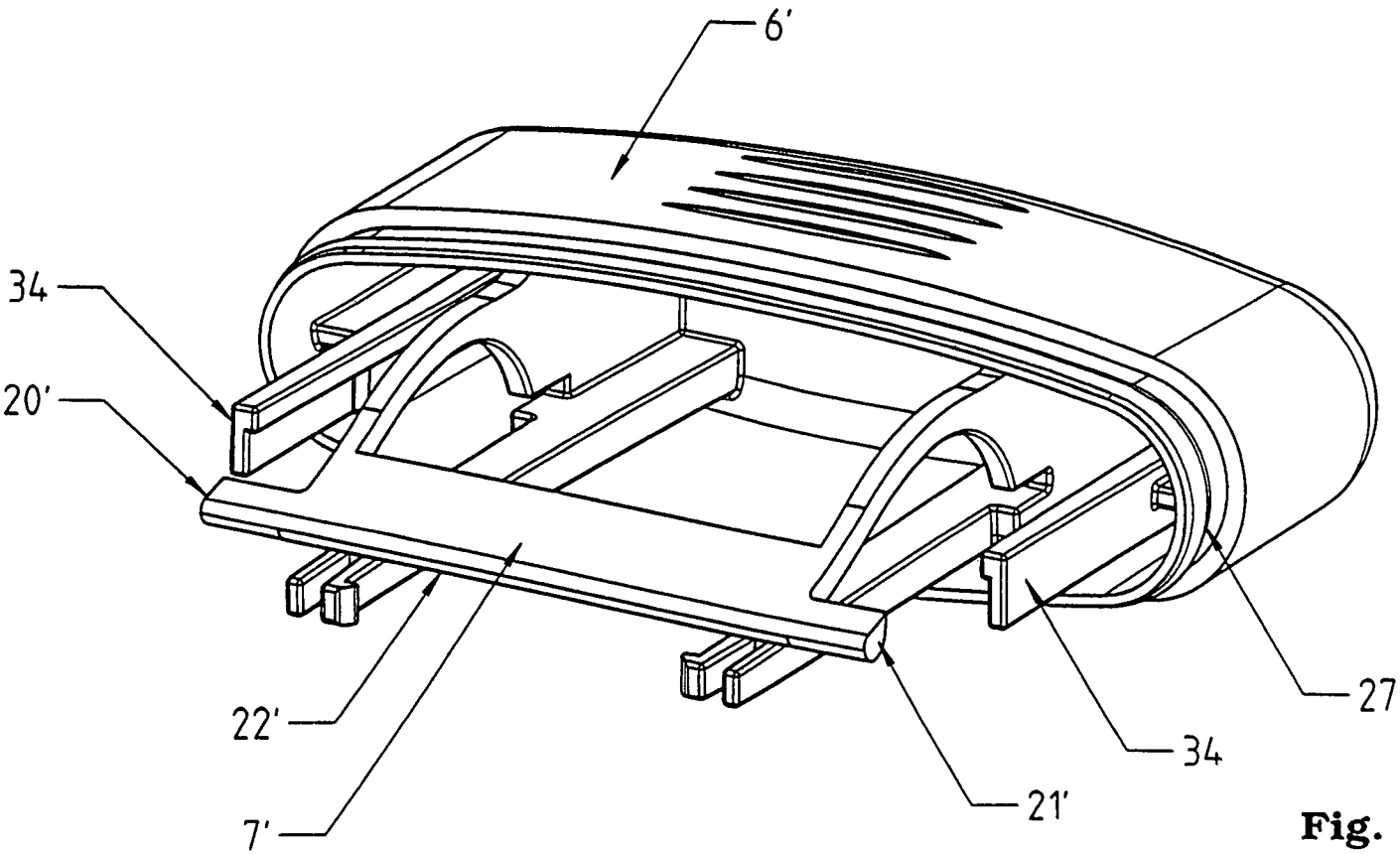

FIG. 13 shows a perspective view of the component 14'. FIG. 14 shows a perspective view of the lid 6'.

Figure 15:
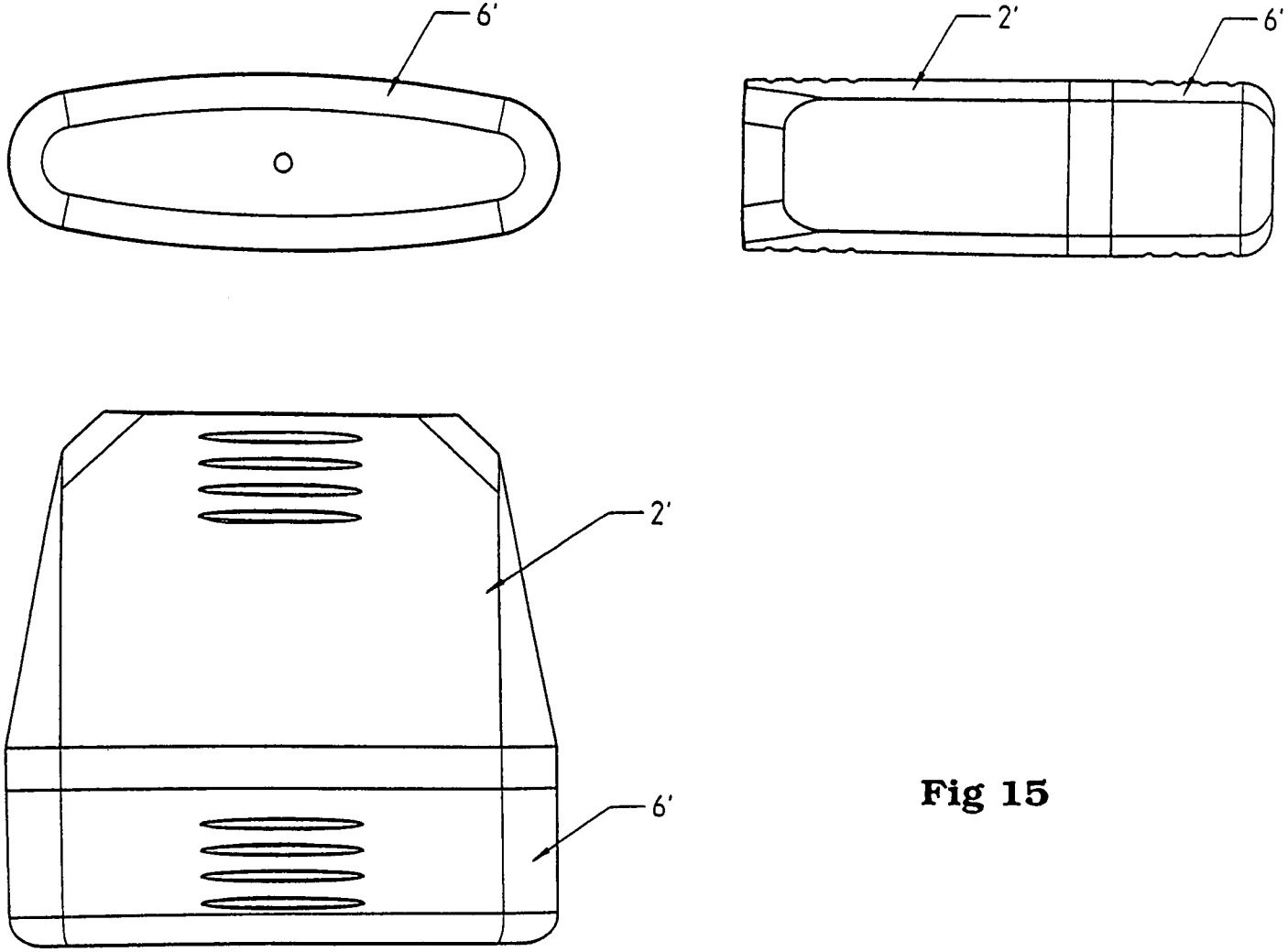

FIG. 15 shows three views of a closed dispenser according to FIG. 10. The upper left in FIG. 15 shows a view of the lid 6' in its sliding direction. The view on the upper right in FIG. 15 shows a side view of the display according to FIG. 10. The lower left in FIG. 15 shows a top view of the dispenser according to FIG. 10.

As far as additional advantageous embodiments and refinements of the teaching according to the invention are concerned, reference is hereby made to the general part of the description on the one hand and to the patent claims on the other hand.

The invention claimed is:

1. A dispenser for administering strip-shaped substances, comprising a housing having a chamber to store a stack of the strip-shaped substances, said housing forming a removal opening for the strip-shaped substances that can be opened and closed again with a lid, said lid being joined to the housing, and said lid being joined to a transport bar that can be moved together with the lid in order to transport the strip-shaped substances, wherein the transport bar is elastically pre-tensioned and mounted in the housing in such a way that it is at a distance from the stack when the removal opening is closed, and wherein at a defined open position of the lid, the transport bar travels underneath a latch of a guide track in order to come to a launch end of the guide track.

2. The dispenser according to claim 1, wherein, in order for the transport bar to be at a distance from the stack, the transport bar rests on a spacer when the removal opening is closed.

3. The dispenser according to claim 1, wherein, when the removal opening is opened, the transport bar executes a transport stroke to pick up and transport a strip-shaped substance from the stack to the removal opening.

4. The dispenser according to claim 3, wherein the transport bar travels at least partially underneath a guide track during the transport stroke.

5. The dispenser according to claim 1, wherein, when the removal opening is being closed, the transport bar is guided on a guide track inside the housing in such a way that it passes the stack of strip-shaped substances without making contact.

6. The dispenser according to claim 5, wherein the guide track is configured as a ramp that is made up of a component that is latched in the housing.

7. The dispenser according to claim 5, wherein, when the removal opening is being closed, the transport bar moves from a traverse end of the guide track onto a spacer due to its elastic pre-tensioning, so that the lid closes the housing.

8. The dispenser according to claim 1, wherein the transport bar is configured as an elastically deformable element from which side arms project on both sides.

9. The dispenser according to claim 1, wherein the lid and the transport bar are made in one piece, and said lid is joined to the housing via clamping cams.

10. The dispenser according to claim 9, wherein the clamping cams are configured in one piece with a rigid part onto which the lid is attached in an articulated manner so as to pivot via a film hinge.

11. The dispenser according to claim 1, wherein the lid executes a translatory motion during the opening and closing of the removal opening.

12. The dispenser according to claim 1, wherein the lid has an encircling gasket on the side facing the removal opening.

13. The dispenser according to claim 12, wherein the gasket is configured as an olive gasket.

14. The dispenser according to claim 1, wherein said dispenser is formed as a three-part structure, wherein each of the three individual parts is injection-molded.

15. A dispenser for administering strip-shaped substances, comprising a housing, said housing having a chamber to store a stack of the strip-shaped substances, said housing forming a removal opening for the strip-shaped substances that can be opened and closed again with a lid, said lid being joined to the housing, and said lid being joined to a transport bar that can be moved together with the lid in order to transport the strip-shaped substances, wherein the transport bar is elastically pre-tensioned and mounted in the housing in such a way that it is at a distance from the stack when the removal opening is closed and guided by a guide track inside said housing, said guide track being configured as a ramp that is made up of a component that is latched in the housing, wherein when the removal opening is being closed, the transport bar is guided on the guide track in such a way that it passes the stack of strip-shaped substances without making contact with the strip-shaped substances.

16. A dispenser for administering strip-shaped substances, comprising a housing, said housing having a chamber to store a stack of the strip-shaped substances, said housing forming a removal opening for the strip-shaped substances that can be opened and closed again with a lid, said lid being joined to the housing, and said lid being joined to a transport bar that can be moved together with the lid in order to transport the strip-shaped substances, wherein the transport bar is elastically pre-tensioned and mounted in the housing in such a way that it is at a distance from the stack when the removal opening is closed and guided by a guide track inside said housing, wherein when the removal opening is being closed, the transport bar is guided on the guide track in such a way that it passes the stack of strip-shaped substances without making contact with the strip-shaped substances and moves from a traverse end of the guide track onto a spacer due to its elastic pre-tensioning, so that the lid closes the housing.

17. A dispenser for administering strip-shaped substances, comprising a housing, said housing having a chamber to store a stack of the strip-shaped substances, said housing forming a removal opening for the strip-shaped substances that can be opened and closed again with a lid, said lid being joined to the housing, and said lid being joined to a transport bar that can be moved together with the lid in order to transport the strip-shaped substances, the transport bar being configured as an elastically deformable element from which side arms project on both sides, wherein the transport bar is elastically pre-tensioned and mounted in the housing in such a way that it is at a distance from the stack when the removal opening is closed.

18. A dispenser for administering strip-shaped substances, comprising a housing, said housing having a chamber to store a stack of the strip-shaped substances, said housing forming a removal opening for the strip-shaped substances that can be opened and closed again with a lid, said lid being joined to the housing, and said lid being joined to a transport bar that can be moved together with the lid in order to transport the strip-shaped substances, wherein the transport bar is elastically pre-tensioned and mounted in the housing in such a way that it is at a distance from the stack when the removal opening is closed, wherein the lid and the transport bar are made in one piece, and said lid is joined to said housing via clamping cams, said clamping cams being configured as one piece with a rigid part onto which the lid is attached in an articulated manner so as to enable the lid to pivot relative to said housing via a film hinge.

19. A dispenser for administering strip-shaped substances, comprising a housing, said housing having a chamber to store a stack of the strip-shaped substances, said housing forming a removal opening for the strip-shaped substances that can be opened and closed again with a lid, said lid being joined to the housing and including an encircling gasket on a side of the lid facing the removal opening, said lid being joined to a transport bar that can be moved together with the lid in order to transport the strip-shaped substances, wherein the transport bar is elastically pre-tensioned and mounted in the housing in such a way that it is at a distance from the stack when the removal opening is closed.

20. The dispenser according to claim 19, wherein the gasket is configured as an olive gasket.

* * * * *